US010765934B1

(12) United States Patent
Matthews

(10) Patent No.: US 10,765,934 B1
(45) Date of Patent: Sep. 8, 2020

(54) JUGGLING SIMULATION GAME

(71) Applicant: Gladia Matthews, Teaneck, NJ (US)

(72) Inventor: Gladia Matthews, Teaneck, NJ (US)

( * ) Notice: Subject to any disclaimer, the term of this patent is extended or adjusted under 35 U.S.C. 154(b) by 0 days.

(21) Appl. No.: 16/443,994

(22) Filed: Jun. 18, 2019

(51) Int. Cl.

| | |
|---|---|
| ***A63F 9/00*** | (2006.01) |
| ***A63F 9/24*** | (2006.01) |
| ***A63F 13/00*** | (2014.01) |
| ***H05B 45/10*** | (2020.01) |

(52) U.S. Cl.
CPC ..... *A63F 9/0096* (2013.01); *A63F 9/24* (2013.01); *H05B 45/10* (2020.01); *A63F 2009/2408* (2013.01); *A63F 2009/2454* (2013.01)

(58) Field of Classification Search
CPC ..... A63F 9/0096
See application file for complete search history.

(56) References Cited

U.S. PATENT DOCUMENTS 3,225,472 A 12/1965 Guida
4,008,893 A 2/1977 Yoseloff
4,322,074 A 3/1982 James
4,364,619 A * 12/1982 Inayat-Khan ..... H05K 3/365 200/5 A
4,438,926 A * 3/1984 Yokoi ..... G04G 17/005 368/10
4,582,322 A 4/1986 Yokoi
5,060,941 A * 10/1991 Barra ..... A63F 9/0096 273/460
D618,284 S 6/2010 Ichimura
2002/0005614 A1 1/2002 Krull
2018/0207484 A1 7/2018 Briggs

OTHER PUBLICATIONS

"Gypsy Juggler (Meadows 1978) Ganneplay" by FastRMacR. YouTube—Broadcast Yourself. [dated Dec. 31, 2013], [online], retrieved on [Apr. 17, 2020]. <URL:https://www.youtube.com/watch?v=aDW51awYLnE>. Including Still Image of Video. 1 Page. (Year: 2013).*

"Arcade Game". Wikipedia.org. [dated Jun. 16, 2018], [online], [retrieved on Apr. 17, 2020]. <URL:https://web.archive.org/web/20180616135431/https://en.wikipedia.org/wiki/Arcade game>. 31 Pages. (Year: 2018).*

* cited by examiner

*Primary Examiner* — Milap Shah
(74) *Attorney, Agent, or Firm* — Kyle A. Fletcher, Esq.

(57) ABSTRACT

The juggling simulation game is a game of skill. The juggling simulation game is an electrically operated game. The juggling simulation game simulates the activity of juggling. The juggling simulation game comprises a base structure, a vertical structure, and a control circuit. The base structure attaches to the vertical structure. The base structure and the vertical structure contains the control circuit. The control circuit simulates the appearance and the movement of a plurality of balls during the juggling process. The control circuit further forms an interface that allows for the change of direction of the simulated motion of the plurality of balls.

16 Claims, 7 Drawing Sheets

JUGGLING SIMULATION GAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of human necessities and games including games not otherwise provided for, more specifically, a reaction time game. (A63F9/0096)

SUMMARY OF INVENTION

The juggling simulation game is a game of skill. The juggling simulation game is an electrically operated game. The juggling simulation game simulates the activity of juggling. The juggling simulation game comprises a base structure, a vertical structure, and a control circuit. The base structure attaches to the vertical structure. The base structure and the vertical structure contains the control circuit. The control circuit simulates the appearance and the movement of a plurality of balls during the juggling process. The control circuit further forms an interface that allows for the change of direction of the simulated motion of the plurality of balls.

These together with additional objects, features and advantages of the juggling simulation game will be readily apparent to those of ordinary skill in the art upon reading the following detailed description of the presently preferred, but nonetheless illustrative, embodiments when taken in conjunction with the accompanying drawings.

In this respect, before explaining the current embodiments of the juggling simulation game in detail, it is to be understood that the juggling simulation game is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the juggling simulation game.

It is therefore important that the claims be regarded as including such equivalent construction insofar as they do not depart from the spirit and scope of the juggling simulation game. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
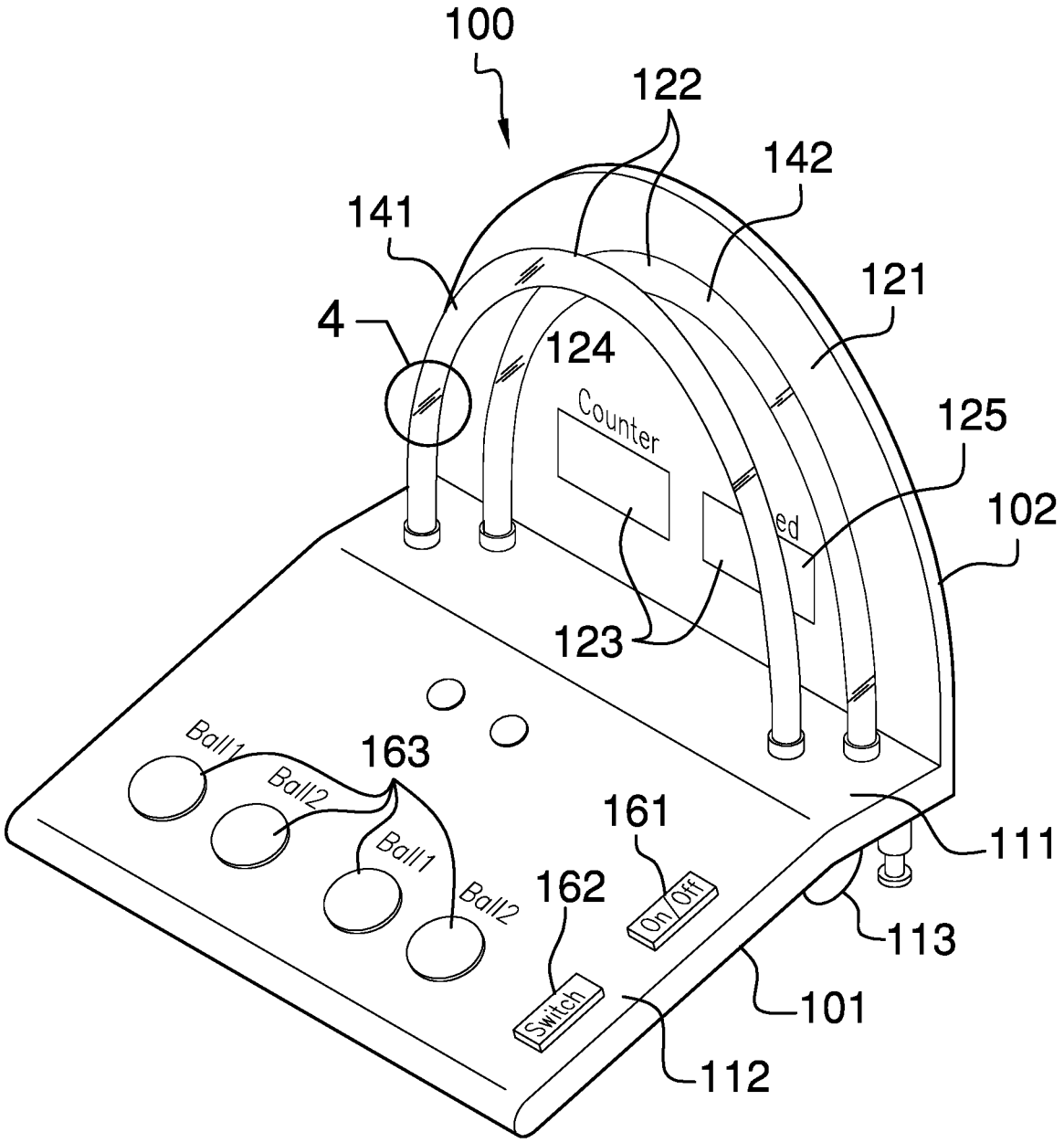
FIG. 1 is a perspective view of an embodiment of the disclosure.
Figure 2:
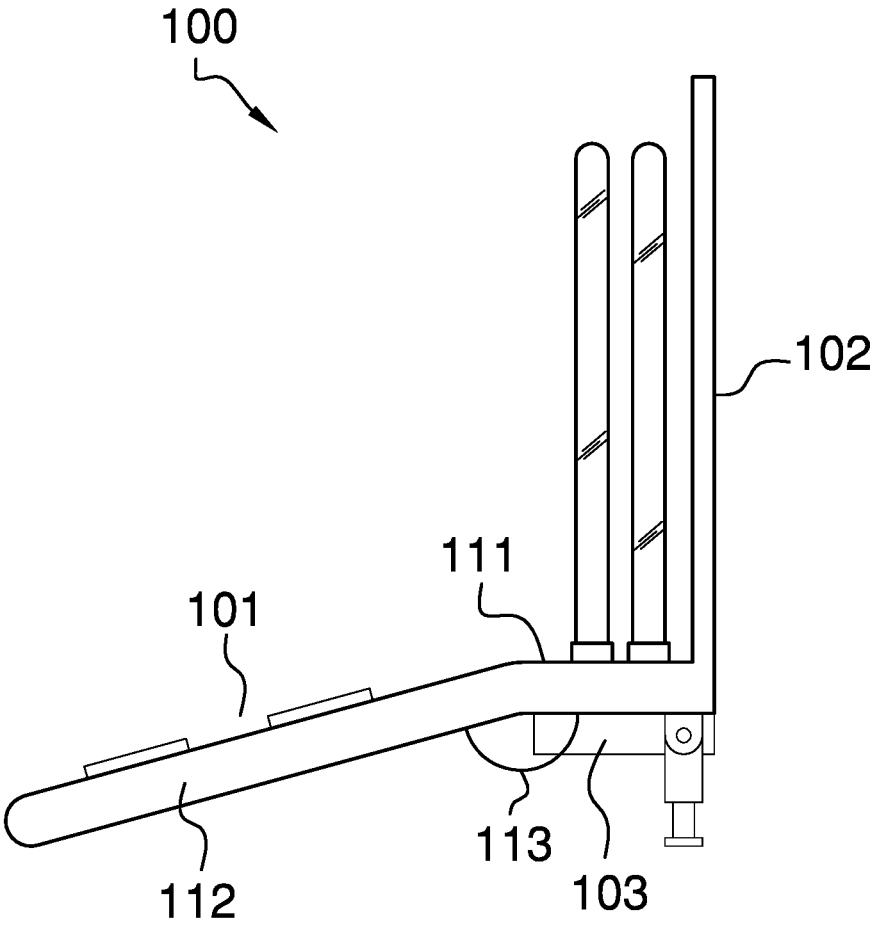
FIG. 2 is a side view of an embodiment of the disclosure.
Figure 3:
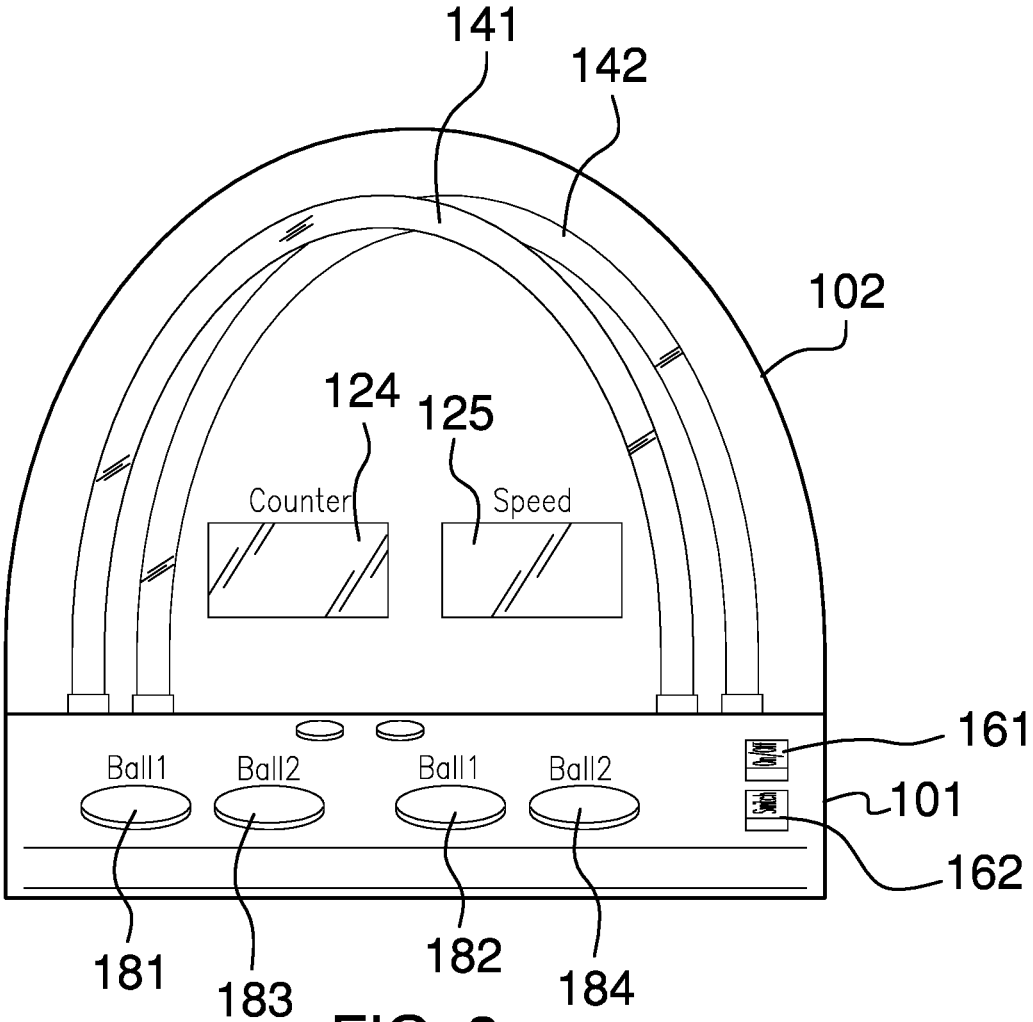
FIG. 3 is a front view of an embodiment of the disclosure.
Figure 4:
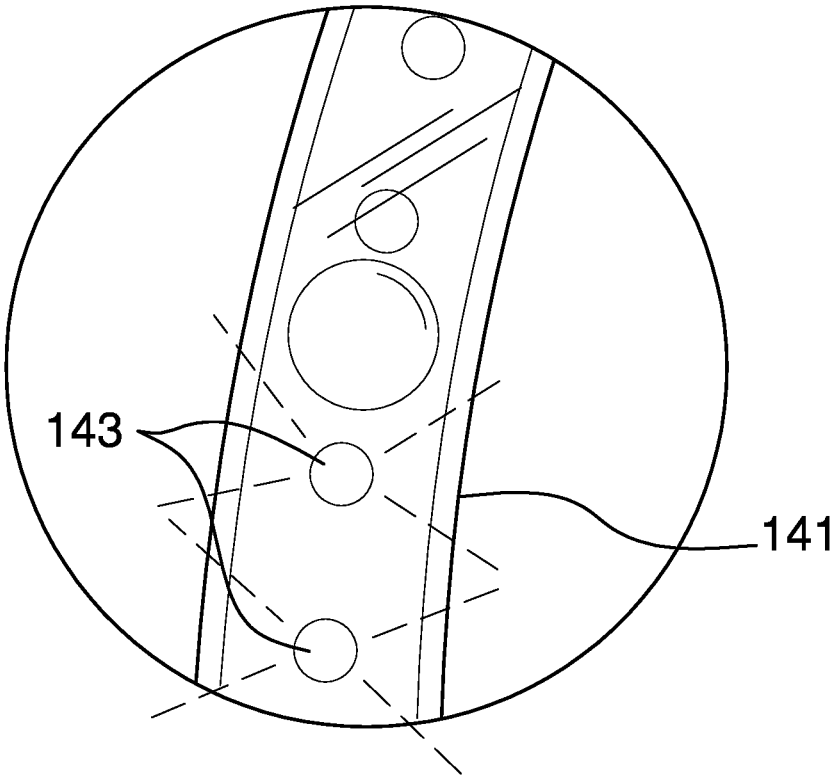
FIG. 4 is a detail view of an embodiment of the disclosure.
Figure 5:
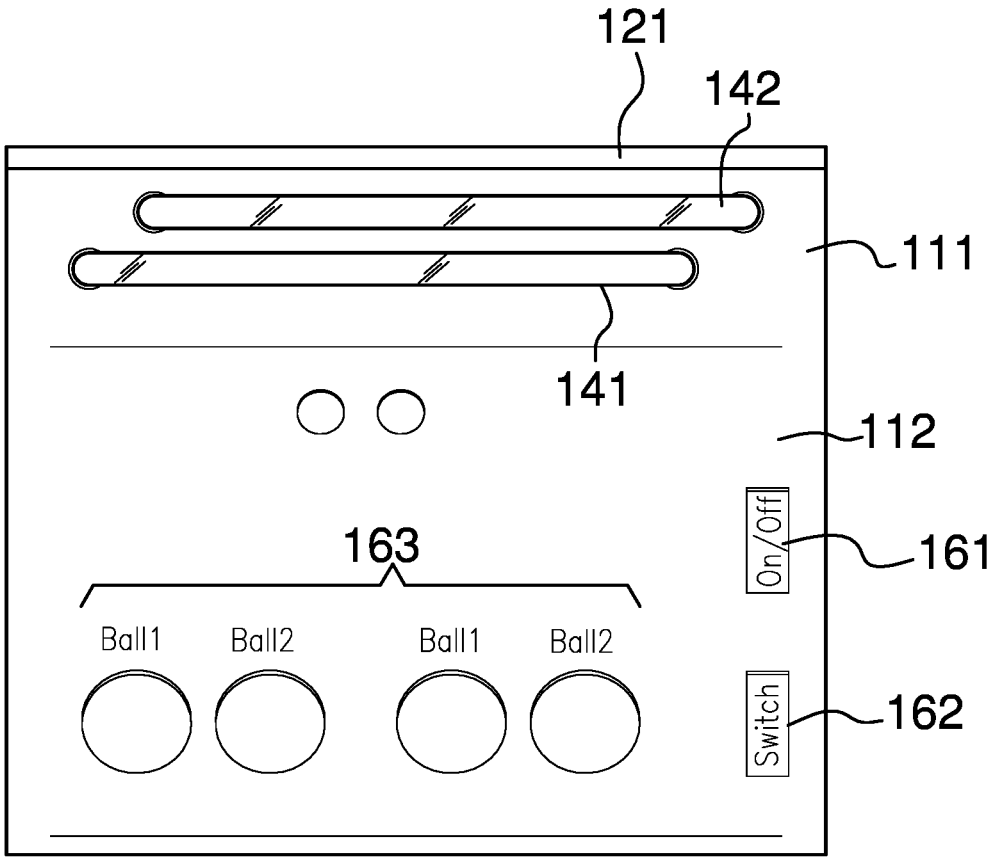
FIG. 5 is a top view of an embodiment of the disclosure.
Figure 6:
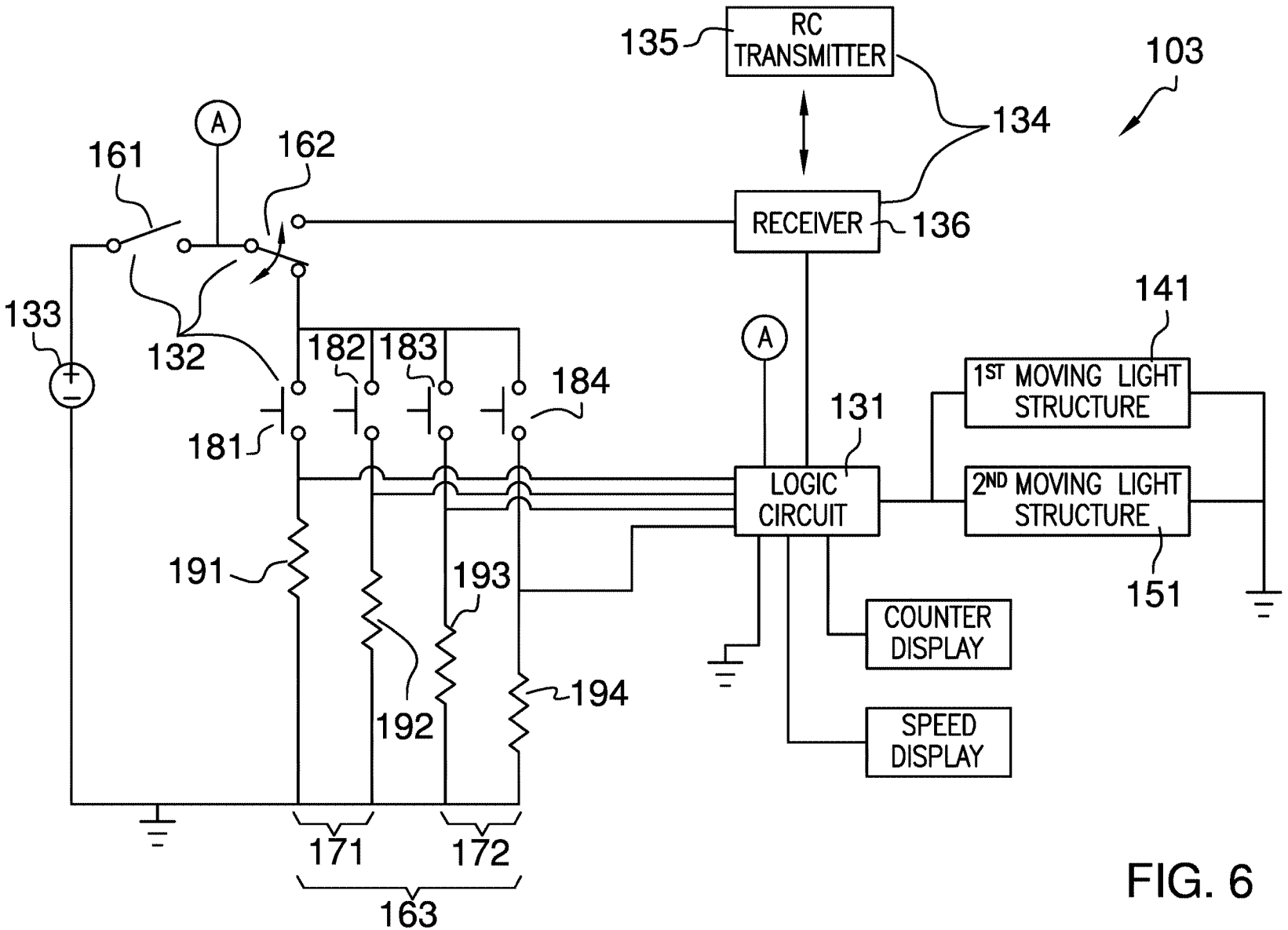
FIG. 6 is a block diagram of an embodiment of the disclosure.
Figure 7:
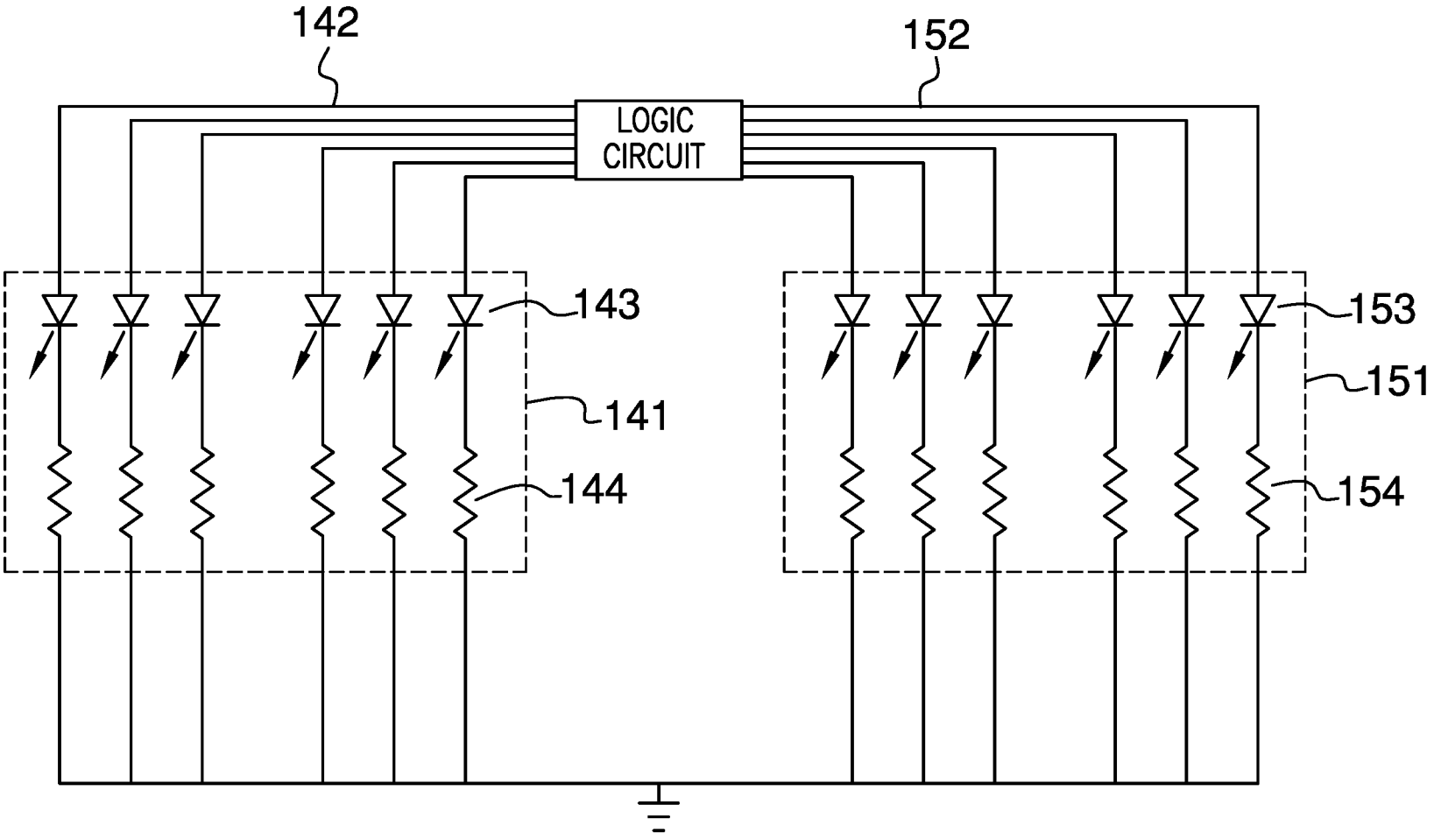
FIG. 7 is a block diagram of an embodiment of the disclosure.

Detailed reference will now be made to one or more potential embodiments of the disclosure, which are illustrated in FIGS. 1 through 7.

The juggling simulation game 100 (hereinafter game) is a game 100 of skill. The game 100 is electrically operated. The game 100 simulates the activity of juggling. The game 100 comprises a base structure 101, a vertical structure 102, and a control circuit 103. The base structure 101 attaches to the vertical structure 102. The base structure 101 and the vertical structure 102 contains the control circuit 103. The control circuit 103 simulates the appearance and the movement of a plurality of balls during the juggling process. The control circuit 103 further forms an interface that allows for the change of direction of the simulated motion of the plurality of balls.

The base structure 101 is a mechanical device. The base structure 101 roughly forms the horizontal structure of the game 100. The base structure 101 contains the elements of the control circuit 103 that controls the operation of the game 100. The base structure 101 presents the interface that controls the simulation of the appearance and the movement of a plurality of balls during the juggling process. The base structure 101 comprises a horizontal disk 111 and a canted disk 112. The horizontal disk 111 attaches to the canted disk 112 to form a cant angle 113.

The horizontal disk 111 is a disk-shaped plate. The horizontal disk 111 attaches the base structure 101 to the vertical structure 102. The horizontal disk 111 forms a pedestal on which a portion of the vertical structure 102 mounts. Specifically, the elements of the vertical structure 102 that simulate the appearance and the movement of a plurality of balls during the juggling process mount on the horizontal disk 111. The horizontal disk 111 can further comprise a plurality of stanchions that allow for the adjustment of the orientation of the horizontal disk 111 such that the horizontal disk 111 is perpendicular to the force of gravity when the game 100 rests on a supporting surface. The use of a plurality of stanchions for this purpose is well-known and documented in the mechanical arts.

The canted disk 112 is a disk-shaped plate. The canted disk 112 attaches to the edge of the horizontal disk 111 that is distal from the attachment edge of the horizontal disk 111 to the vertical disk 121 of the vertical structure 102. The vertical disk 121 of the vertical structure 102 is defined elsewhere in this disclosure. The canted disk 112 presents the interface that controls the simulation of the appearance and the movement of a plurality of balls during the juggling process such that the interface is accessible during the play of the game 100.

The canted disk 112 attaches to the horizontal disk 111 to form the cant angle 113. The cant angle 113 inclines the interface on the canted disk 112 relative to the elements of the vertical structure 102 that simulate the appearance and the movement of a plurality of balls during the juggling process to improve the overall performance during play of the game 100.

The vertical structure 102 is a mechanical device. The vertical structure 102 forms the vertically oriented elements of the structure of the game 100. The vertical structure 102 presents the elements of the control circuit 103 that simulate the appearance and the movement of a plurality of balls during the juggling process. The vertical structure 102 displays relevant information regarding the user performance in playing the game 100. The vertical structure 102 comprises a vertical disk 121, a plurality of displays 122, and a plurality of moving light structures 123.

The vertical disk 121 is a disk-shaped plate. The horizontal disk 111 attaches to the vertical disk 121 such that the faces of the vertical disk 121 are perpendicular to the faces of the horizontal disk 111. The vertical disk 121 presents the display of the relevant information regarding the user performance in playing the game 100.

Each of the plurality of displays 122 is an electrical device. Each of the plurality of displays 122 mounts on the vertical disk 121 such that the plurality of displays 122 are visible during play of the game 100. Each of the plurality of displays 122 displays information relevant to the play of the game 100. The control circuit 103 controls the operation of each of the plurality of displays 122. The plurality of displays 122 further comprises a seven segment counter display 124 and a seven segment speed display 125.

The seven segment counter display 124 is an electrical display device. The seven segment counter display 124 visibly mounts on the vertical disk 121. The seven segment counter display 124 visually displays a first number. The first number displayed by the seven segment counter display 124 equals the number of times that the direction of apparent motion of a moving light structure selected from the plurality of moving light structures 123 has changed during the play of the game 100.

The seven segment speed display 125 is an electrical display device. The seven segment speed display 125 visibly mounts on the vertical disk 121. The seven segment speed display 125 visually displays a second number. The second number displayed by the seven segment speed display 125 is a measure of the speed of the apparent motion of a moving light within the plurality of moving light structures 123.

The plurality of moving light structures 123 mount on the horizontal disk 111 of the base structure 101 such that each of the plurality of moving light structures 123 are visible. Each of the plurality of moving light structures 123 is an electrical device that simulates the appearance and the movement of a plurality of balls during the juggling process. Each of the plurality of moving light structures 123 simulates the appearance and the movement of a single ball during the juggling process. Each of the plurality of moving light structures 123 simulates the appearance and the movement of a single ball in a first direction during the juggling process. Each of the plurality of moving light structures 123 simulates the appearance and the movement of a single ball in a second direction during the juggling process. The second direction is the reverse of the first direction.

Each of the plurality of moving light structures 123 displays what appears to be a point of light that moves along a parabolic arc that is parallel to the force of gravity. This "moving" point of light provides the illusion of the movement of a juggled ball. The control circuit 103 controls the "motion" of the moving light by individually controlling the illumination of multiple light sources contained within the plurality of moving light structures 123.

The plurality of moving light structures 123 comprises a first moving light structure 141 and a second moving light structure 151.

The first moving light structure 141 is an electrical device. The first moving light structure 141 generates an illumination such that the illumination gives the appearance of a moving point of light. The first moving light structure 141 is a parabola-shaped structure such that the moving light generated by the first moving light structure 141 appears to move along a parabolic arc. The logic circuit 131 controls the operation of the first moving light structure 141. The first moving light structure 141 further comprises a first signal transfer bus 142, a first plurality of LEDs 143, and a first plurality of limit resistors 144.

The first signal transfer bus 142 is a collection individual electrical conductors used to transmit electrical control signals to the first moving light structure 141. There is a one to one correspondence between each individual electrical conductor contained in the first signal transfer bus 142 and each LED contained in the first plurality of LEDs 143. Specifically, each electrical conductor selected from the first signal transfer bus 142 electrically connects to a single LED selected from the first plurality of LEDs 143.

Each of the first plurality of LEDs 143 is a light source. The logic circuit 131 controls the illumination of each LED contained within the first plurality of LEDs 143. The illumination of any first LED contained within the first plurality of LEDs 143 is controlled independently from the illumination of any second LED selected from the first plurality of LEDs 143. The logic circuit 131 controls the sequence of illumination of each LED contained within the first plurality of LEDs 143 such that the first plurality of LEDs 143 creates the appearance of a moving point of light along a parabolic arc. Each of the first plurality of LEDs 143 is positioned relative to each other to form the shape of a parabolic arc. There is a one to one correspondence between each LED contained within the first plurality of LEDs 143 and each limit resistor selected from the first plurality of limit resistors 144.

Each limit resistor selected from the first plurality of limit resistors 144 limits the flow of electricity through its associated LED selected from the first plurality of LEDs 143. Each limit resistor selected from the first plurality of limit resistors 144 attaches to its associated LED to form a series circuit with the individual electrical conductor selected from the first signal transfer bus 142 that electrically connects to the associated LED.

The second moving light structure 151 is an electrical device. The second moving light structure 151 generates an illumination such that the illumination gives the appearance of a moving point of light. The second moving light structure 151 is a parabola-shaped structure such that the moving light generated by the second moving light structure 151 appears to move along a parabolic arc. The logic circuit 131 controls the operation of the second moving light structure 151. The second moving light structure 151 further comprises a second signal transfer bus 152, a second plurality of LEDs 153, and a second plurality of limit resistors 154.

The second signal transfer bus 152 is a collection individual electrical conductors used to transmit electrical control signals to the second moving light structure 151. There is a one to one correspondence between each individual electrical conductor contained in the second signal transfer bus 152 and each LED contained in the second plurality of LEDs 153. Specifically, each electrical conductor selected from the second signal transfer bus 152 electrically connects to a single LED selected from the second plurality of LEDs 153.

Each of the second plurality of LEDs 153 is a light source. The logic circuit 131 controls the illumination of each LED contained within the second plurality of LEDs 153. The illumination of any first LED contained within the second plurality of LEDs 153 is controlled independently from the illumination of any second LED selected from the second plurality of LEDs 153. The logic circuit 131 controls the sequence of illumination of each LED contained within the second plurality of LEDs 153 such that the second plurality of LEDs 153 creates the appearance of a moving point of light along a parabolic arc. Each of the second plurality of LEDs 153 is positioned relative to each other to form the shape of a parabolic arc. There is a one to one correspondence between each LED contained within the second plurality of LEDs 153 and each limit resistor selected from the second plurality of limit resistors 154.

Each limit resistor selected from the second plurality of limit resistors 154 limits the flow of electricity through its associated LED selected from the second plurality of LEDs 153. Each limit resistor selected from the second plurality of limit resistors 154 attaches to its associated LED to form a series circuit with the individual electrical conductor selected from the second signal transfer bus 152 that electrically connects to the associated LED.

The control circuit 103 is an electrical circuit. The control circuit 103 controls the overall operation of the game 100. The control circuit 103 generates the display of the simulation of the appearance and the movement of a plurality of balls during the juggling process. The control circuit 103 manages the interface that controls the simulation of the appearance and the movement of a plurality of balls during the juggling process. The control circuit 103 displays the relevant information regarding the user performance in playing the game 100. The control circuit 103 comprises a logic circuit 131, a plurality of switches 132, an external power source 133, and a remote control circuit 134. The logic circuit 131, the plurality of switches 132, the external power source 133, and the remote control circuit 134 are electrically interconnected.

The logic circuit 131 is an electric circuit. The logic circuit 131 controls the operation of the plurality of displays 122 of the vertical structure 102. The logic circuit 131 controls the operation of the plurality of moving light structures 123 of the vertical structure 102. The logic circuit 131 monitors the plurality of switches 132 and the remote control circuit 134. The logic circuit 131 controls the operation of the game 100 based on the inputs received from the plurality of switches 132 and the remote control circuit 134.

The external power source 133 is an externally provided source of the electrical power required to operate the game 100. The external power source 133 is defined in greater detail elsewhere in this disclosure.

The remote control circuit 134 is an electrical apparatus. The remote control circuit 134 is a wireless device that allow the game 100 to be operated at a distance. The remote control circuit 134 provides operating inputs to the logic circuit 131 that are relevant to the operation of the game 100. The inputs provided by the remote control circuit 134 to the logic circuit 131 determine the direction of motion of the moving light in each of the plurality of moving light structures 123. The remote control circuit 134 comprises an RC transmitter 135 and an RC receiver 136.

The RC transmitter 135 is a radio frequency transmitter. The RC transmitter 135 transmits information to the RC receiver 136 regarding the desired direction of motion of the moving light in each of the plurality of moving light structures 123. The use of an RC transmitter 135 for this purpose is well-known and documented in the electrical arts. The RC receiver 136 is a radio frequency receiver. The RC receiver 136 receives the operating information transmitted by the RC transmitter 135 regarding the desired direction of motion of the moving light in each of the plurality of moving light structures 123 and transmits the received operating information to the logic circuit 131 for appropriate action. The use of an RC receiver 136 for this purpose is well-known and documented in the electrical arts.

Each of the plurality of switches 132 is an electrical switch. Each of the plurality of switches 132 controls a portion of the operation of the vertical structure 102. The plurality of switches 132 controls the flow of electrical power into the control circuit 103. The plurality of switches 132 determines the source of the operating inputs monitored by the logic circuit 131. The source of the operating inputs is selected from the group consisting of the plurality of switches 132 and the remote control circuit 134. The plurality of switches 132 further comprises a power switch 161, a mode switch 162, and a plurality of control switches 163.

The power switch 161 is a maintained electrical switch. The power switch 161 controls the flow of electrical power from the external power source 133 and the logic circuit 131. The power switch 161 further controls the flow of electrical power from the external power source 133 and the mode switch 162. The power switch 161 is effectively the on-off switch of the game 100.

The mode switch 162 is a maintained electrical switch. The mode switch 162 is a single pole double throw switch. The mode switch 162 controls the flow of electric power from the power switch 161 to an electrical sub-circuit of the control circuit 103 selected from the group consisting of the remote control circuit 134 and the plurality of control switches 163 of the plurality of switches 132. The position of the mode switch 162 determines which electrical sub-circuit is selected to receive electric power from the external power source 133 through the power switch 161. The logic circuit 131 exclusively responds to the inputs provided by the electrical sub-circuit that is receiving electrical power.

Each of the plurality of control switches 163 is a momentary switching structure. Each of the plurality of control switches 163 provides operating inputs to the logic circuit 131 when the plurality of control switches 163 receives electrical power from the mode switch 162. Each of the plurality of control switches 163 generates a voltage that is monitored by the logic circuit 131 that allows the logic circuit 131 to determine the desired direction of apparent motion of the light generated by a moving light structure selected from the plurality of moving light structures 123. The plurality of control switches 163 comprises a first moving light switch set 171 and a second moving light switch set 172.

The first moving light switch set 171 provides the operating inputs to the logic circuit 131 that indicate the direction of apparent motion of the light generated by the first moving light structure 141. The first moving light switch set 171 comprises a first moving light switch 181, a second moving light switch 182, a first pull-down resistor 191, and a second pull-down resistor 192. The first moving light switch 181, the second moving light switch 182, the first pull-down resistor 191, and the second pull-down resistor 192 are electrically interconnected.

The first moving light switch 181 is a normally open momentary switch. The first moving light switch 181 is wired in series between the mode switch 162 and the first pull-down resistor 191 such that the first pull-down resistor 191 presents a voltage to the logic circuit 131 when: a) the first moving light switch 181 is actuated; and, b) the mode of the mode switch 162 is selected to provide electrical power to the plurality of control switches 163. The actuation of the first moving light switch 181 indicates to the logic circuit 131 that the apparent motion of the light generated by the first moving light structure 141 is in a first direction.

The first pull-down resistor 191 is a resistor that forms a series circuit with the first moving light switch 181. The first pull-down resistor 191 limits the flow of electricity through the first moving light switch 181. The first pull-down resistor 191 presents a voltage that is monitored by the logic circuit 131 such that the logic circuit 131 detects when the first moving light switch 181 is actuated.

The second moving light switch 182 is a normally open momentary switch. The second moving light switch 182 is wired in series between the mode switch 162 and the second pull-down resistor 192 such that the second pull-down resistor 192 presents a voltage to the logic circuit 131 when: a) the second moving light switch 182 is actuated; and, b) the mode of the mode switch 162 is selected to provide electrical power to the plurality of control switches 163. The actuation of the second moving light switch 182 indicates to the logic circuit 131 that the apparent motion of the light generated by the first moving light structure 141 is in a second direction. The second direction is the direction opposite to the first direction.

The second pull-down resistor 192 is a resistor that forms a series circuit with the second moving light switch 182. The second pull-down resistor 192 limits the flow of electricity through the second moving light switch 182. The second pull-down resistor 192 presents a voltage that is monitored by the logic circuit 131 such that the logic circuit 131 detects when the second moving light switch 182 is actuated.

The design of the logic circuit 131 is such that when both the first moving light switch 181 and the second moving light switch 182 are simultaneously actuated, the play of the game 100 terminates.

The second moving light switch set 172 provides the operating inputs to the logic circuit 131 that indicate the direction of apparent motion of the light generated by the second moving light structure 151. The second moving light switch set 172 comprises a third moving light switch 183, a fourth moving light switch 184, a third pull-down resistor 193, and a fourth pull-down resistor 194. The third moving light switch 183, the fourth moving light switch 184, the third pull-down resistor 193, and the fourth pull-down resistor 194.

The third moving light switch 183 is a normally open momentary switch. The third moving light switch 183 is wired in series between the mode switch 162 and the third pull-down resistor 193 such that the third pull-down resistor 193 presents a voltage to the logic circuit 131 when: a) the third moving light switch 183 is actuated; and, b) the mode of the mode switch 162 is selected to provide electrical power to the plurality of control switches 163.

The actuation of the third moving light switch 183 indicates to the logic circuit 131 that the apparent motion of the light generated by the second moving light structure 151 is in a third direction. The third direction is that same direction as a direction selected from the group consisting of the first direction and the second direction.

The third pull-down resistor 193 is a resistor that forms a series circuit with the third moving light switch 183. The third pull-down resistor 193 limits the flow of electricity through the third moving light switch 183. The third pull-down resistor 193 presents a voltage that is monitored by the logic circuit 131 such that the logic circuit 131 detects when the third moving light switch 183 is actuated.

The fourth moving light switch 184 is a normally open momentary switch. The fourth moving light switch 184 is wired in series between the mode switch 162 and the fourth pull-down resistor 194 such that the fourth pull-down resistor 194 presents a voltage to the logic circuit 131 when: a) the fourth moving light switch 184 is actuated; and, b) the mode of the mode switch 162 is selected to provide electrical power to the plurality of control switches 163. The actuation of the fourth moving light switch 184 indicates to the logic circuit 131 that the apparent motion of the light generated by the second moving light structure 151 is in a fourth direction. The fourth direction is the direction opposite to the third direction.

The fourth pull-down resistor 194 is a resistor that forms a series circuit with the fourth moving light switch 184. The fourth pull-down resistor 194 limits the flow of electricity through the fourth moving light switch 184. The fourth pull-down resistor 194 presents a voltage that is monitored by the logic circuit 131 such that the logic circuit 131 detects when the fourth moving light switch 184 is actuated.

The design of the logic circuit 131 is such that when both the third moving light switch 183 and the fourth moving light switch 184 are simultaneously actuated, the play of the game 100 terminates.

The following definitions were used in this disclosure:

Bus: As used in this disclosure, a bus is a physical arrangement of one or more electrical conductors that are used to facilitate the transfer of electrical signals between components of an electrical circuit.

Cant: As used in this disclosure, a cant is an angular deviation from one or more reference lines (or planes) such as a vertical line (or plane) or a horizontal line (or plane).

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Display: As used in this disclosure, a display is a surface upon which is presented an image, potentially including, but not limited to, graphic images and text, that is interpretable by an individual viewing the projected image in a meaningful manner.

External Power Source: As used in this disclosure, an external power source is a source of the energy that is externally provided to enable the operation of the present disclosure. Examples of external power sources include, but are not limited to, electrical power sources and compressed air sources.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Game: As used in this disclosure, a game is a competition between two or more players wherein each of the two or more players attempt to outperform the other players according to a previously determined set of rules. The winner of the game is traditionally rewarded with social or economic benefits. The primary purpose of a game is often to provide entertainment.

Game of Skill: As used in this disclosure, a game of skill is a competition wherein the outcome of the competition will at least partially depends upon the skill of a player.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Incline: As used in this disclosure, the term inclines is a term that refers to a cant that is formed between a first line or surface and a reference line or surface. The line or surface that is not the reference line or surface is the "inclined" line or surface.

LED: As used in this disclosure, an LED is an acronym for a light emitting diode. A light emitting diode is a diode that is also a light source. Because of close operational correspondence of the function of the cathode and anode of an organic LEDs and the cathode and anode of a semiconductor LED, organic LEDs are included in this definition.

Limit Resistor: As used in this disclosure, a limit resistor is an electrical resistor that is used to limit the flow of electric current through an electrical circuit.

Logic Circuit: As used in this disclosure, a logic circuit is an electrical device that receives one or more digital or analog inputs and uses those digital or analog inputs to generate one or more digital or analog outputs. This disclosure allows, but does not assume, that the logic circuit is programmable.

Maintained Switch: A used in this disclosure, a maintained switch is a switch that maintains the position that was set in the most recent switch actuation. A maintained switch works in an opposite manner to a momentary switch.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Orientation: As used in this disclosure, orientation refers to the positioning of a first object relative to: 1) a second object; or, 2) a fixed position, location, or direction.

Pedestal: As used in this disclosure, a pedestal is an intermediary load bearing structure that that transfers a load path between a supporting surface and an object, structure, or load.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprise the surfaces of the plate that would not be considered faces as defined above. As defined in this disclosure, plates may be made of any material, but are commonly made of metal, plastic, and wood. When made of wood, a plate is often referred to as a board or a plank.

Poles, Throws, and Switches: As used in this disclosure, the terms pole and throw are descriptions associated with an electrical switch. A pole refers to an electrical circuit the switch feeds electrical current into. The number of poles associated with the switch refers to the maximum number of independent circuits a switch can theoretically support. Because the circuits supported by the poles of a switch can be interconnected, a switch will often support fewer independent electrical circuits than the actual number of poles. The number of throws associated with a switch refers to the maximum number of electrical connections that can be made within an individual pole of the switch.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pull-Down Resistor: As used in this disclosure, a pull-down resistor is an electrical resistor that is used within a switching circuit or logic circuit to present a predetermined signal voltage to a logic element or switching element; and/or, b) is used as a limit resistor to control the flow of electricity through a circuit element.

Receiver: As used in this disclosure, a receiver is a device that is used to receive and demodulate electromagnetic radiation such as radio signals.

Remote Control: As used in this disclosure, remote control means the establishment of control of a device from a distance. Remote control is generally accomplished through the use of an electrical device that generates electrically based control signals that are transmitted via radio frequencies or other means to the device.

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Seven Segment Display: As used in this disclosure, a seven segment display is a commercially available electrical device used to display primarily numerical information. Each character displayed by the seven segment display comprises 7 line segments roughly configured to display the number "8." The use of a seven segment display is well-known and documented in the electrical arts.

Stanchion: As used in this disclosure, a stanchion refers to a vertically oriented prism-shaped pole, post, or support.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Transmitter: As used in this disclosure, a transmitter is a device that is used to generate and transmit electromagnetic radiation such as radio signals.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A juggling simulation device comprising a base structure, a vertical structure, and a control circuit;

wherein the base structure attaches to the vertical structure;

wherein the base structure and the vertical structure contain the control circuit;

wherein the control circuit simulates the appearance and the movement of a juggling process;

wherein the juggling simulation device is a game of skill;

wherein the juggling simulation device is electrically operated;

wherein the juggling simulation device simulates the juggling process;

wherein the base structure presents an interface that controls the simulation of the appearance and the movement of a plurality of balls during the juggling process;

wherein the vertical structure forms a vertically oriented elements of the juggling simulation device;

wherein the control circuit manages the interface that controls the simulation of the appearance and the movement of a plurality of balls during the juggling process;

wherein the control circuit comprises a logic circuit, a plurality of switches, an external power source, and a remote control circuit;

wherein the logic circuit, the plurality of switches, the external power source, and the remote control circuit are electrically interconnected;

wherein the base structure comprises a horizontal disk and a canted disk;

wherein the horizontal disk attaches to the canted disk to form a cant angle;

wherein the canted disk presents an interface that controls the simulation of the appearance and the movement of a plurality of balls during the juggling process such that the interface is accessible during the play of the juggling simulation device;

wherein the vertical structure comprises a vertical disk, a plurality of displays, and a plurality of moving light structures;

wherein the plurality of moving light structures mount on the horizontal disk of the base structure such that each of the plurality of moving light structures is visible;

wherein each of the plurality of moving light structures is an electrical device that simulates the appearance and the movement of a plurality of balls during the juggling process;

wherein each of the plurality of moving light structures displays what appears to be a point of light that moves along a parabolic arc that is parallel to the force of gravity;

wherein this moving point of light provides the illusion of the movement of a juggled ball.

2. The juggling simulation device according to claim 1 wherein the base structure is a mechanical device;

wherein the base structure contains the elements of the control circuit that controls the operation of the juggling simulation device.

3. The juggling simulation device according to claim 2 wherein the vertical structure is a mechanical device;

wherein the vertical structure presents the elements of the control circuit that simulate the appearance and the movement of a plurality of balls during the juggling process;

wherein the vertical structure displays relevant information regarding the playing performance of the juggling simulation device.

4. The juggling simulation device according to claim 3 wherein the control circuit is an electrical circuit;

wherein the control circuit controls the overall operation of the juggling simulation device;

wherein the control circuit generates the display of the simulation of the appearance and the movement of a plurality of balls during the juggling process;

wherein the control circuit displays the relevant information regarding a user performance in playing the juggling simulation device.

5. The juggling simulation device according to claim 4 wherein the horizontal disk is a disk-shaped plate;

wherein the horizontal disk attaches the base structure to the vertical structure;

wherein the canted disk is a disk-shaped plate;

wherein the canted disk attaches to the edge of the horizontal disk that is distal from the attachment edge of the horizontal disk to a vertical disk of the vertical structure.

6. The juggling simulation device according to claim 5 wherein the vertical disk is a disk-shaped plate;

wherein the horizontal disk attaches to the vertical disk such that a face of the vertical disk are perpendicular to a face, of the horizontal disk;

wherein the vertical disk presents the display of the relevant information regarding the user performance in playing the juggling simulation device;

wherein the plurality of moving light structures attach to the horizontal disk.

7. The juggling simulation device according to claim 6 wherein each of the plurality of displays is an electrical device;

wherein each of the plurality of displays mounts on the vertical disk such that the plurality of displays are visible during play of the juggling simulation device;

wherein each of the plurality of displays displays information relevant to the play of the juggling simulation device;

wherein the control circuit controls the operation of each of the plurality of displays;

wherein the plurality of displays further comprises a seven segment counter display and a seven segment speed display;

wherein the seven segment counter display is an electrical display device;

wherein the seven segment counter display visibly mounts on the vertical disk;

wherein the seven segment counter display visually displays a first number;

wherein the first number displayed by the seven segment counter display equals the number of times that the direction of apparent motion of a moving light structure selected from the plurality of moving light structures has changed during the play of the juggling simulation device;

wherein the seven segment speed display is an electrical display device;

wherein the seven segment speed display visibly mounts on the vertical disk;

wherein the seven segment speed display visually displays a second number;

wherein the second number displayed by the seven segment speed display is a measure of the speed of the apparent motion of a moving light within the plurality of moving light structures.

8. The juggling simulation device according to claim 7 wherein the plurality of moving light structures comprises a first moving light structure and a second moving light structure;

wherein the first moving light structure is an electrical device;

wherein the first moving light structure generates an illumination such that the illumination gives the appearance of a moving point of light;

wherein the first moving light structure is a parabola-shaped structure such that the moving light generated by the first moving light structure appears to move along a parabolic arc;

wherein the logic circuit controls the operation of the first moving light structure;

wherein the second moving light structure is an electrical device;

wherein the second moving light structure generates an illumination such that the illumination gives the appearance of a moving point of light;

wherein the second moving light structure is a parabola-shaped structure such that the moving light generated by the second moving light structure appears to move along a parabolic arc;

wherein the logic circuit controls the operation of the second moving light structure.

9. The juggling simulation device according to claim 8 wherein the first moving light structure further comprises a first signal transfer bus, a first plurality of LEDs, and a first plurality of limit resistors;

wherein the first signal transfer bus, the first plurality of LEDs, and the first plurality of limit resistors are electrically interconnected;

wherein the second moving light structure further comprises a second signal transfer bus, a second plurality of LEDs, and a second plurality of limit resistors;

wherein the second signal transfer bus, the second plurality of LEDs, and the second plurality of limit resistors are electrically interconnected.

10. The juggling simulation device according to claim 9 wherein the first signal transfer bus is a collection individual electrical conductors used to transmit electrical control signals to the first moving light structure;

wherein there is a one to one correspondence between each individual electrical conductor contained in the first signal transfer bus and each LED contained in the first plurality of LEDs;

wherein each electrical conductor selected from the first signal transfer bus electrically connects to a single LED selected from the first plurality of LEDs;

wherein the second signal transfer bus is a collection individual electrical conductors used to transmit electrical control signals to the second moving light structure;

wherein there is a one to one correspondence between each individual electrical conductor contained in the second signal transfer bus and each LED contained in the second plurality of LEDs;

wherein each electrical conductor selected from the second signal transfer bus electrically connects to a single LED selected from the second plurality of LEDs.

11. The juggling simulation device according to claim 10
wherein each of the first plurality of LEDs is a light source;
wherein the logic circuit controls the illumination of each LED contained within the first plurality of LEDs;
wherein the illumination of any first LED contained within the first plurality of LEDs is controlled independently from the illumination of any second LED selected from the first plurality of LEDs;
wherein the logic circuit controls the sequence of illumination of each LED contained within the first plurality of LEDs such that the first plurality of LEDs creates the appearance of a moving point of light along a parabolic arc;
wherein each of the first plurality of LEDs is positioned relative to each other to form the shape of a parabolic arc;
wherein each of the second plurality of LEDs is a light source;
wherein the logic circuit controls the illumination of each LED contained within the second plurality of LEDs;
wherein the illumination of any first LED contained within the second plurality of LEDs is controlled independently from the illumination of any second LED selected from the second plurality of LEDs;
wherein the logic circuit controls the sequence of illumination of each LED contained within the second plurality of LEDs such that the second plurality of LEDs creates the appearance of a moving point of light along a parabolic arc;
wherein each of the second plurality of LEDs is positioned relative to each other to form the shape of a parabolic arc.

12. The juggling simulation device according to claim 11
wherein there is a one to one correspondence between each LED contained within the first plurality of LEDs and each limit resistor selected from the first plurality of limit resistors;
wherein each limit resistor selected from the first plurality of limit resistors limits the flow of electricity through its associated LED selected from the first plurality of LEDs;
wherein each limit resistor selected from the first plurality of limit resistors attaches to its associated LED to form a series circuit with the individual electrical conductor selected from the first signal transfer bus that electrically connects to the associated LED;
wherein there is a one to one correspondence between each LED contained within the second plurality of LEDs and each limit resistor selected from the second plurality of limit resistors;
wherein each limit resistor selected from the second plurality of limit resistors limits the flow of electricity through its associated LED selected from the second plurality of LEDs;
wherein each limit resistor selected from the second plurality of limit resistors attaches to its associated LED to form a series circuit with the individual electrical conductor selected from the second signal transfer bus that electrically connects to the associated LED.

13. The juggling simulation device according to claim 12
wherein the logic circuit is an electric circuit;
wherein the logic circuit controls the operation of the plurality of displays of the vertical structure;
wherein the logic circuit controls the operation of the plurality of moving light structures of the vertical structure;
wherein the logic circuit monitors the plurality of switches and the remote control circuit;
wherein the logic circuit controls the operation of the juggling simulation device based on the inputs received from the plurality of switches and the remote control circuit.

14. The juggling simulation device according to claim 13
wherein the remote control circuit is an electrical apparatus;
wherein the remote control circuit comprises an RC transmitter and an RC receiver;
wherein the RC transmitter is a radio frequency transmitter;
wherein the RC transmitter transmits information to the RC receiver regarding the desired direction of motion of the moving light in each of the plurality of moving light structures;
wherein the use of an RC transmitter for this purpose is well-known and documented in the electrical arts;
wherein the RC receiver is a radio frequency receiver;
wherein the RC receiver receives the operating information transmitted by the RC transmitter regarding the desired direction of motion of the moving light in each of the plurality of moving light structures and transmits the received operating information to the logic circuit for appropriate action.

15. The juggling simulation device according to claim 14
wherein the plurality of switches further comprises a power switch, a mode switch, and a plurality of control switches;
wherein the power switch is a maintained electrical switch;
wherein the power switch controls the flow of electrical power from the external power source and the logic circuit;
wherein the power switch further controls the flow of electrical power from the external power source and the mode switch;
wherein the power switch is effectively the on-off switch of the juggling simulation device;
wherein the mode switch is a maintained electrical switch;
wherein the mode switch is a single pole double throw switch;
wherein the mode switch controls the flow of electric power from the power switch to an electrical sub-circuit of the control circuit selected from the group consisting of the remote control circuit and the plurality of control switches of the plurality of switches;
wherein the position of the mode switch determines which electrical sub-circuit is selected to receive electric power from the external power source through the power switch;
wherein the logic circuit exclusively responds to the inputs provided by the electrical sub-circuit that is receiving electrical power.

16. The juggling simulation device according to claim 15
wherein each of the plurality of control switches is a momentary switching structure;
wherein each of the plurality of control switches provides operating inputs to the logic circuit when the plurality of control switches receives electrical power from the mode switch;
wherein each of the plurality of control switches generates a voltage that is monitored by the logic circuit that allows the logic circuit to determine the desired direction of apparent motion of the light generated by a moving light structure selected from the plurality of moving light structures;

wherein the plurality of control switches comprises a first moving light switch set and a second moving light switch set;

wherein the first moving light switch set provides the operating inputs to the logic circuit that indicate the direction of apparent motion of the light generated by the first moving light structure;

wherein the second moving light switch set provides the operating inputs to the logic circuit that indicate the direction of apparent motion of the light generated by the second moving light structure.

* * * * *